United States Patent [19]

Marchadour

[11] Patent Number: 4,586,545

[45] Date of Patent: May 6, 1986

[54] SOLID PRODUCT FILLING AND MEASURING APPARATUS

[76] Inventor: Jean C. Marchadour, 7734 Avondale Dr., Salt Lake City, Utah 84121

[21] Appl. No.: 656,341

[22] Filed: Oct. 1, 1984

[51] Int. Cl.[4] ..... B65B 1/24; B65B 1/04; B65B 3/04

[52] U.S. Cl. ..... 141/1; 141/73; 141/145; 141/258

[58] Field of Search ..... 141/250-284, 141/129-191, 346-362, 71-81, 1-12

[56] References Cited

U.S. PATENT DOCUMENTS 893,583 7/1908 Hey et al. ..... 141/145

2,953,959 9/1960 Weinert ..... 141/73

4,226,269 10/1980 Carr et al. ..... 141/361

*Primary Examiner*—Houston S. Bell, Jr.

*Attorney, Agent, or Firm*—Thorpe, North & Western

[57] ABSTRACT

An improved machine for filling solid food products into containers. The machine includes a feed hopper, a feed tube, a dosing assembly and a container filling station. The improvement of the present invention involves a dosing assembly which includes a plurality of needle-like elements adapted to advance cross-wise into the feed tube to temporarily halt the movement of food products, and then retract from the feed tube to allow continued movement of the food products.

10 Claims, 4 Drawing Figures

SOLID PRODUCT FILLING AND MEASURING APPARATUS

BACKGROUND OF THE INVENTION

1. Field:

The invention relates to apparatus and methods for dispensing small, solid products, such as cauliflower, broccoli, beans, brussel sprouts, mixed vegetables, cherries and other fruits, carrots, etc., into containers such as cans or jars.

2. State of the Art:

Apparatus and methods for automatically filling containers, such as cans or jars, with both food and non-food products are well known in the art. Such apparatus and methods are used to fill containers with liquid, semi-liquid, pasty or solid products including both food products and non-food products. The apparatus and methods must, of course, be capable of adequately filling each container with the proper dose of the product.

Apparatus and methods disclosed and used in the prior art have generally been acceptable when used in filling containers with liquid or pasty products. However, the prior apparatus and methods have had a significant drawback with respect to filling containers with solid food products. In particular, the methods used in preparing the proper dose of product has previously resulted in cutting and shearing a portion of the solid food products. Such shearing, as might be expected, lowers the overall quality of the products dispensed in the container.

It would be highly desirable to provide improved apparatus and methods which would not shear or damage the solid food products as they are being dispensed into cans or jars.

3. Objectives:

A principal objective of the present invention is to provide new and improved apparatus for filling small, dimensioned, food products into containers such as cans and jars. A particular objective is to provide improved apparatus and an improved method of filling containers with small, dimensioned, food products wherein the shearing, cutting and damaging of the food products is essentially eliminated. It is a further objective of the invention to provide improved apparatus and method for efficiently, rapidly and accurately dosing and filling containers such as cans and jars with small, dimensioned, food products.

SUMMARY OF THE INVENTION

The above and other objects of the invention are achieved in accordance with the present invention by providing an improved apparatus for dosing and filling containers with a small, dimensioned, food product and an improved method of filling the containers using the improved apparatus. The invention involves an improvement in a machine or apparatus of the type comprising a feed hopper, a feed tube, a dosing assembly and a container filling station, wherein the dosing assembly includes a moveable plate having a plurality of pockets which are adapted to be filled successively from the feed tube as the plate moves in intermittent fashion, with the respective pockets moving successively beneath the feed tube. The filled pockets continuously move between the feed tube to the container filling station and back to the feed tube. At the container filling station, the food products in the filled pockets are emptied from the respective pockets and delivered to respective containers, with the emptied pockets then moving back to the feed tube to be filled again.

The improvement in such a machine or apparatus in accordance with the present invention comprises a piston which is positioned beneath the feed tube and is adapted to move upwardly into a respective pocket in the moving plate when the respective pocket is positioned beneath the feed tube during a stationary portion of the intermittent movement of the plate. The piston is further adapted to move downwardly from and clear the respective pocket such that the moving plate is free to move during a subsequent portion of the indexing or intermittent movement of the plate.

In one embodiment of the invention, a plurality of needle-like elements are further provided. The needle-like elements are positioned substantially parallel with each other in a common plane, with the common plane being substantially normal to the longitudinal axis of the feed tube. The needle-like elements are mounted a preset distance from the bottom end of the feed tube. A plurality of spaced apertures or small openings are provided in the side of the feed tube. These apertures are located in the common plane of the needle-like elements, with the respective apertures being aligned with mutually respective needle-like elements.

Apparatus is provided for intermittently advancing and retracting the needle-like elements so that when the needle-like elements are advanced, they extend through their mutually respective apertures in the feed tube to form a gate across the feed tube. The gate blocks movement of material in the feed tube.

Advantageously, whenever the moveable plate is set to move and during the indexing or intermittent movement of the plate, the needle-like elements are advanced so that material cannot drop below the finger-like elements in the feed tube. The moveable plate moves just sufficiently so as to index the next subsequent pocket in the plate beneath the feed tube and over the piston. The plate then stops and begins one of its intermittent, stationary stages, and the piston moves upwardly into the pocket which has been properly indexed and positioned above the piston. After the piston has moved to the desired position in the pocket of the plate, the needle-like elements are retracted from the feed tube, and the small, dimensioned, food products in the feed tube are allowed to fall into the space formed by the portion of the feed tube beneath the finger-like elements and the portion of the pocket in the moveable plate above the piston.

The needle-like elements are then advanced to their gate position within the feed tube so as to prevent further passage of the small, dimensioned, food products, and a specific, dosed amount of the food products is entrained between the piston and the needle-like elements. After the needle-like elements have been advanced to their gate position within the feed tube, the piston is retracted until its upper surface just clears the bottom edge of the moveable plate, so that the dosed amount of food products is contained within the pocket in the plate. With the piston in its retracted position and the needle-like elements in their advanced gate position, the moveable plate moves until the next subsequent pocket therein is brought into alignment with the feed tube, and the cycle of operation of the piston and needle-like elements is repeated. The filled pockets in the moveable plate continue to move intermittently from the feed tube to the container filling station. At the container filling station, the food products in the filled pockets are emptied from the pockets and delivered to respective containers. The emptied pockets then recirculate with the intermittent movement of the moveable plate to the feed tube to be filled again.

Additional objects and features of the invention will become apparent from the following detailed description taken together with the accompanying drawings.

THE DRAWINGS

Particular embodiments of the present invention representing the best mode presently contemplated of carrying out the invention is illustrated in the accompanying drawings in which.

DETAILED DESCRIPTION OF THE ILLUSTRATED EMBODIMENT

Figure 1:
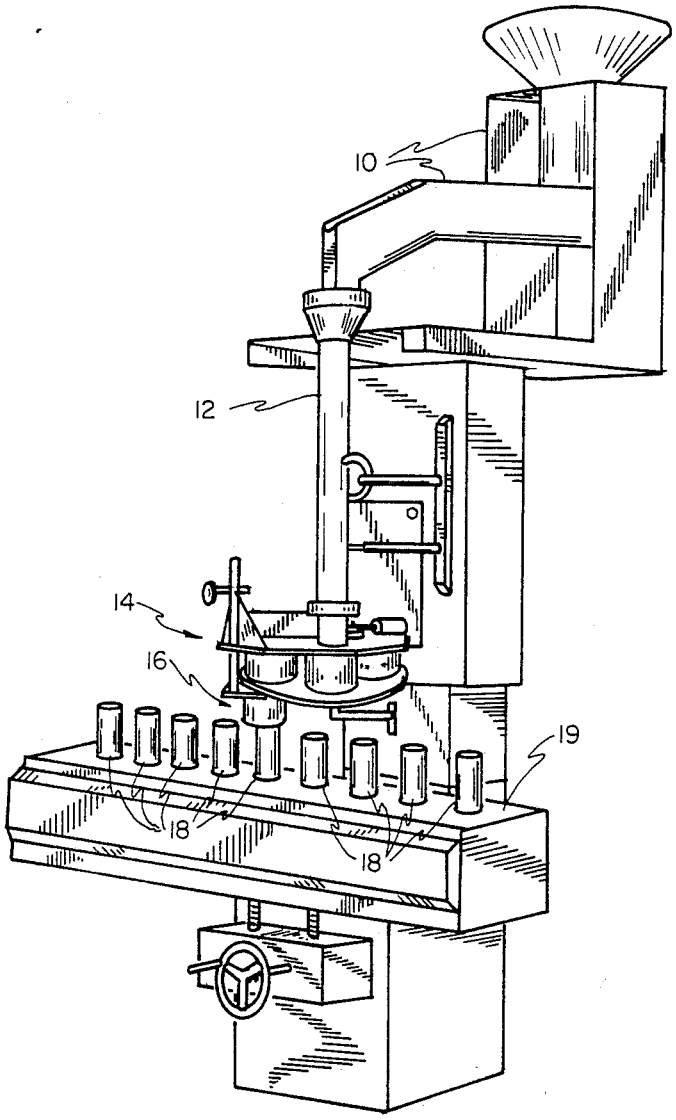
FIG. 1 is a perspective view of improved apparatus made in accordance with the present invention for filling small, solid food products into containers.

Referring to the drawings, there is shown improved apparatus in accordance with the present invention for filling small, solid food products into containers such as cans or jars. The invention pertains to improvements in apparatus of the general type which is well known in the art. The machine or apparatus shown pictorially in FIG. 1, comprises a feed hopper 10 which is adapted to receive the small, solid food products, such as cauliflower, broccoli, beans, brussel sprouts, mixed vegetables, cherries and other fruits, carrots, etc. A feed tube 12 leads downwardly from the hopper 10 to a dosing assembly and a container filling station. The dosing assembly includes a revolving plate or carousel 14 which, in turn, contains a plurality of cavities, openings or pockets which are adapted to be filled successively from the feed tube 12 as the carousel 14 rotates. The carousel 14 rotates in stepped, intermittent fashion so that the cavities, openings or pockets move in a stepped, successive fashion beneath the feed tube. The intermittent motion of the carousel 14 is designed such that each of the respective cavities or pockets in the carousel 14 is positioned beneath the feed tube 12 for a set time period in which food material from the feed tube 12 is introduced into the respective cavity or pocket. At the end of the set time period, the revolving plate or carousel 14 moves in stepped, indexing fashion to bring the next subsequent cavity or pocket in line beneath the feed tube 12.

The filled cavities or pockets in the carousel 14 move intermittently from the feed tube 12 to a container filling station 16 where the contents of the cavities or pockets are dropped or otherwise fed into respective cans or jars 18. The cans or jars 18 are conveyed to and away from the container filling station by a conveyor means such as a conveyor belt 19. The portions of the machine so far described, i.e., the hopper 10, feed tube 12, revolving plate or carousel 14, the container filling station 16 and the means for conveying the cans or jars 18 are well known in the art and do not of themselves form part of the present invention. For that reason, and because the above stated portions of the machine are well known in the art, further detailed description thereof is not deemed necessary. One skilled in the art would have operating knowledge of the prior art portions of the machine as described above, and others can refer to sales literature and other publications in the field of food handling equipment.

In accordance with the present invention, improvements are made in the prior art machines which permit cleaner handling of the food products. That is, the small, dimensioned, food products are handled with better efficiency and without undue damage to the food products. The improvement of the present invention involves provision of a plurality of needle-like elements 20 (FIGS. 2 and 3) in association with the feed tube 12. The needle-like elements 20 are positioned substantially parallel with each other in a common plane. The common plane is substantially normal to the longitudinal axis of the feed tube 12 and spaced from the bottom end of the feed tube.

A plurality of spaced-apart apertures or openings 21 (FIG. 3) are provided in the side of the feed tube 12. The apertures 21 are located in the common plane of the needle-like elements 20, and each is aligned with a respective one of the needle-like elements. Apparatus is provided for intermittently advancing and retracting the needle-like elements so that when the needle-like elements are advanced, they extend through respective apertures 21 in the feed tube 12 to form an effective gate across the feed tube which blocks movement of food product material past the gate.

Figure 3:
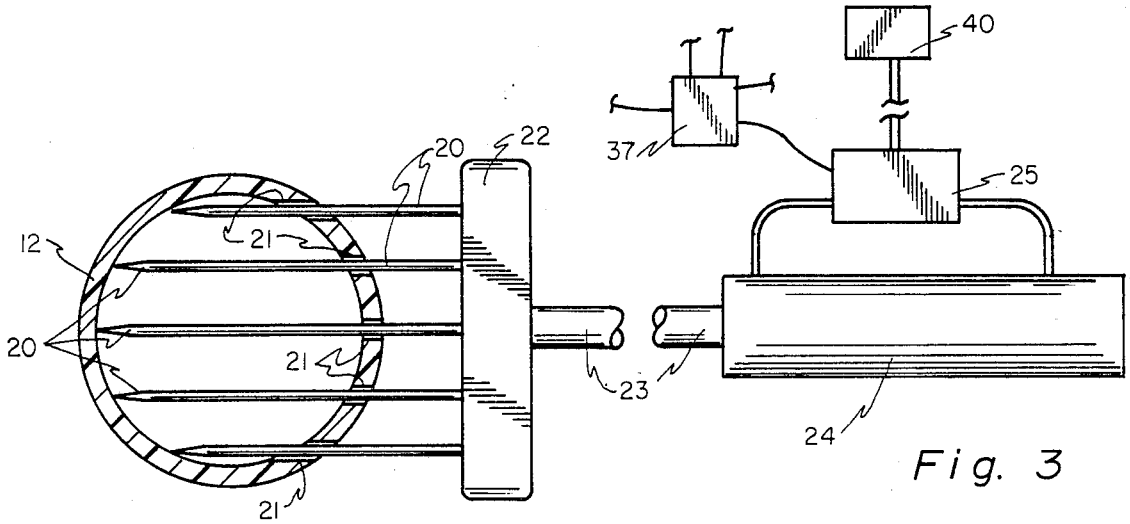
FIG. 3 is a cross-sectional view of the needle-like elements as taken along line 3—3 of FIG. 2.

The needle-like elements 20 are shown in their advanced position in FIG. 3 to extend through respective apertures 21 in the feed tube 12. The elements 20 are sufficiently long such that their forward projecting ends extend to a position adjacent the far side of the feed tube 12. The spacing between the elements 20 in their common plane can be variable depending upon the size of the small, dimensioned, food products which are to be handled by the machinery. If small food items are to be handled, such as mixed vegetables, the elements 20 must be spaced fairly close together to prevent the food from falling between adjacent elements 20. The cross-sectional diameter of the elements 20 may vary over a wide range, but should not be so small as to become instable and incapable of piercing through the pieces of food product being handled. Conversely, the cross section dimension should not be of such a size that undue damage is done to the small pieces of food product which may be pierced by one of the elements. A cross-sectional dimension of from about 0.5 to 2.5 millimeters will generally be acceptable and practicable.

The elements 20 are preferably mounted on a base block 22 which, in turn, is attached to the end of a hydraulically operated push rod 23 disposed in a hydraulic cylinder 24. The hydraulic cylinder 24 is mounted to the frame of the apparatus and is operated intermittently by a control valve 25 (FIG. 3) which controls the flow of hydraulic fluid to the hydraulic cylinder.

A dosing piston 26 (FIG. 2) is preferably provided in combination with the revolving plate or carousel 14. The piston 26 is positioned beneath the feed tube 12 and is adapted to move upwardly into a respective cavity or pocket 15 in the carousel 14 when a respective cavity is positioned beneath the feed tube. For that reason, the cavities, are cylindrical in shape and open through both the bottom and top of the carousel. The piston 26 is further adapted to retract or move downwardly from and clear the cavities 15 so that the carousel 14 is free to revolve after charging the cavities with food product. The piston 26 fits snugly within the cylindrical cavities in the carousel 14 so that pieces of the food product being handled will not get caught between the sides of the piston and the interior surfaces of the cavities. As is shown in FIG. 3, the piston 26 is activated by a push rod 27 which is, in turn, operated by a hydraulic cylinder 28. The hydraulic cylinder 28 is mounted to the frame of the apparatus and is operated intermittently by a control valve 29 which controls the flow of hydraulic fluid to the hydraulic cylinder. Although hydraulic apparatus is shown for providing intermittent movement to the needle-like elements 20 and the piston 26, it will be recognized that various other arrangements including mechanical means could be employed and would be well within the skill of an artisan employed in the design of machines such as those to which the present invention relate.

The revolving carousel 14 is mounted just above a flat plate 30 (FIG. 2) which includes an opening 31 through which the piston 26 moves. The carousel 14 rotates above the flat plate 30 which forms a floor or bottom support for the contents of the cavities 15 in the carousel as the cavities move from beneath the feed tube 12 to the container filling station 16. At the container filling station 16, another opening 32 is provided in the plate 30 through which the contents of the cavities 15 fall into a container such as a jar or can. Clearance between the revolving carousel 14 and the flat plate 30 should not be great enough to trap pieces of the food product contained in the filled cavities 15. Preferably, the clearance will be between about 0.1 milimeters and no greater than about 3 or 4 millimeters. An upper flat plate 33 (FIG. 2) is advantageously positioned immediately above the carousel 14. The upper plate 33 is spaced above the top of the carousel 14 with a clearance within the same range of the clearance given above with respect to the lower flat plate 30. The upper flat plate 33 protects the cavities 15 in the carousel 14 and prevents extraneous material from getting into the cavities. The upper plate 33, of course, has an opening 34 which is coterminous with the lower end of the feed tube 12, so that the food products falling through the feed tube will fall directly into the cavity 15 in the carousel 14.

Figure 4:
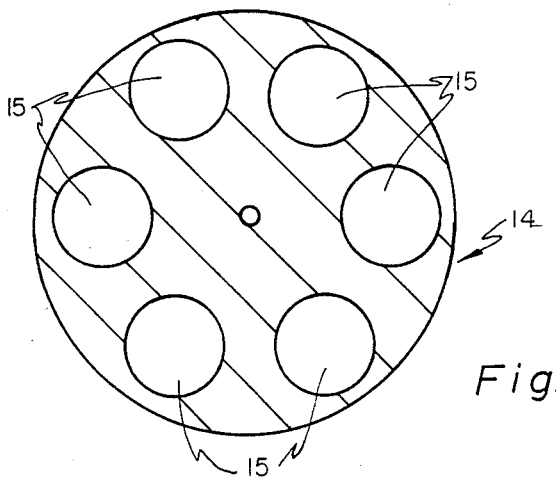
FIG. 4 is a cross-sectional view of the revolving plate or carousel as taken along line 4—4 of FIG. 2.
Figure 2:
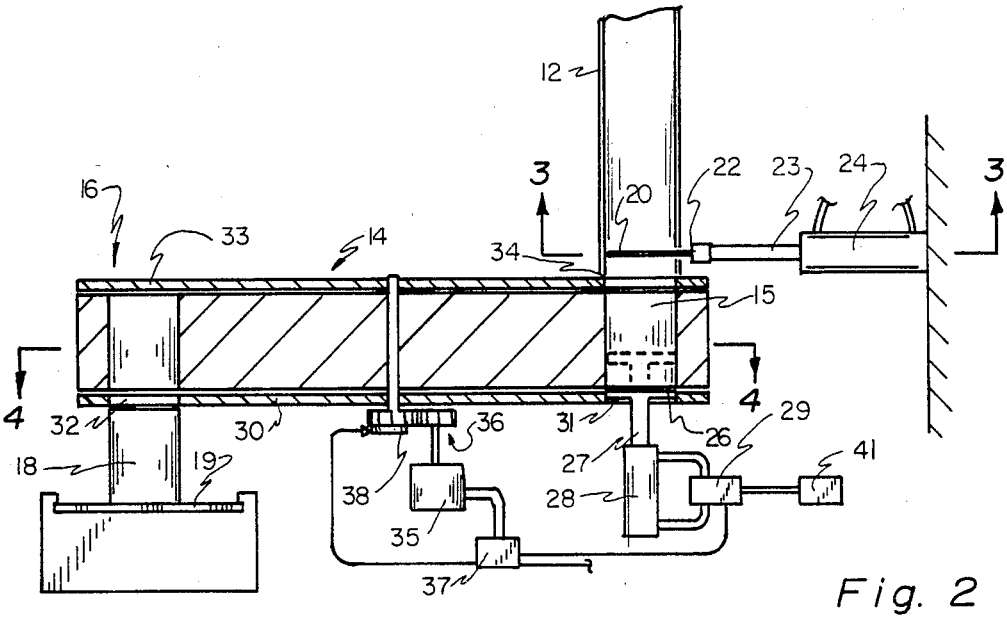
FIG. 2 is a partial cross-sectional view taken through the revolving plate or carousel of the FIG. 1 apparatus and showing the improvements in the dosing mechanism pursuant to the present invention.

The carousel 14 can be made as illustrated in FIGS. 2 and 4, of a solid piece of material through which the cylindrical shaped cavities 15 are formed. It may however, be more economical to construct the carousel from upper and lower flat plates which are spaced from each other. A plurality of cylindrical shaped, hollow tubes would then be positioned between the upper and lower flat plates and spaced around the perimeter thereof. The upper and lower flat plates would have openings therein which would communicate with the hollow interiors of respective cylindrical shaped, hollow tubes.

The volume of the cavities 15 in the carousel 14 is at least as great as the volume of the cans or jars which are being filled and preferably somewhat greater in volume. The needle-like elements 20 are preferably spaced above the upper end of the cavities 15 by a distance of between about 20 to 40 millimeters or by a distance equal to at least the diameter or greatest dimension of the largest piece of food product which is to be handled. Thus, when the needle-like elements 20 advance to their closed position in which the passage of food products in the feed tube 12 is blocked, the largest piece of food material which can be pierced and retained by the needle-like elements 20 will be of such size that it cannot extend to the top surface of the revolving carousel 14. The pieces of material thus retained below the needle-like elements 20 are not subject to being sheared and damaged by the subsequent, intermittent rotational movement of the carousel.

The piston 26 moves upwardly to a position within the cavities 15 such that the cylindrical volume remaining above the piston 26 and under the needle-like elements 20 is equal to the "dosing volume", i.e., the volume of desired food products to be introduced into each can or jar. This dosing volume is never greater than the volume of the cans or jars being filled or of the volume of the cavities 15. In the upward position, food product is deposited onto the piston 26. When the piston is moved downwardly to the retracted position, the piston just clears the lower surface of the carousel 14. In this position, the food product is contained within the respective cavity 15 of the revolving carousel 14. As the carousel 14 then rotates, the carousel slides the food product across the surface of the piston and onto the surface of the flat plate 30. Inasmuch as the dosed volume of food products in each cavity 15 is at least no greater, and preferably somewhat smaller, than the volume of the cavity, the food product does not get impacted between the upper edge of the cavity and upper flat plate 33 which is positioned directly above the carousel 14.

Control apparatus is preferably provided for synchronizing the movement of the revolving carousel 14, the piston 26 and the needle-like elements 20. As illustrated in FIG. 2, a motor 35 is provided to drive the carousel 14 by way of appropriate gearing 36. Movement of the carousel 14 is monitored and controlled by an electronic control module 37 which utilizes a sensor 38, such as a photo sensor or mechanical sensor. The control module 37 periodically signals the motor 35 to cause it to rotate the carousel 14. The control module 37 is also connected to hydraulic control valves 25 (FIG. 3) and 29 associated with the needle-like elements 20 and the push rod 27 of the piston 26, respectively. The control module 37 advantageously could be a stored program microprocessor or a hard-wired control circuit.

As indicated, the control module 37 intermittently causes the revolving carousel 14 to rotate. Prior to and during rotation of the carousel 14, the control module 37 activates the hydraulic control valves 25 and 29 so that the needle-like elements 20 are in their advanced position (to form a gate across the feed tube 12) and the piston 26 is retracted so as to clear the carousel. When the sensor 38 determines that the next subsequent cavity in the carousel 14 has come into alignment beneath the feed tube 12, the carousel is stopped to begin one of its intermittent stationary stages. At the beginning of this stage, the control module 37 activates the control valve 29 to supply hydraulic fluid from a source 41 under pressure to hydraulic cylinder 28 so that the piston 26 is moved upwardly into the cavity 15.

When the piston 26 has moved to its upward position so that a predetermined, volumetric, dosing space has been formed between the needle-like elements 20 and the piston, the control module 37 activates the control valve 25 (FIG. 3) to supply hydraulic fluid from a source 40 under pressure to hydraulic cylinder 24 so that the needle-like elements 20 are retracted from across the feed tube 12. With the needle-like elements 20 retracted, the food material in the feed tube 12 drops downwardly and fills the dosing space above the piston 26. Thereafter, the control module 37 activates the control valve 25 to supply hydrauliuc fluid to hydraulic cylinder 24 so that the needle-like elements 20 are advanced to their position extending across the feed tube 12.

After the needle-like elements 20 have been repositioned in their advanced position across the feed tube 12, the control module 37 activates the control valve 29 (FIG. 2) to supply hydraulic fluid from the source 41 to hydraulic cylinder 28 so that the piston 26 is retracted from and clears the cavity 15. The piston 26 is preferably retracted to a position in which the upper surface thereof is substantially coplanar with the upper surface of the flat plate 30. Once the piston has been retracted, the carousel 14 is rotated until the next subsequent cavity therein is directly beneath the feed tube 12. The cycle is then continuously repeated, with the filled cavities 15 moving intermittently from the feed tube 12 to the container filling station 16. At the container filling station, the filled cavity in the carousel aligns with the opening 32 so that the food product in the cavity drops through the opening into cans or jars positioned beneath the opening. When the cavities 15 in the carousel 14 have been emptied, they progressively move, with the intermittent rotation of the carousel, back to the filling position beneath the feed tube 12.

Although preferred embodiments of the improved apparatus and method of automatically filling containers such as cans or jars have been illustrated and described, it is to be understood that the present disclosure is made by way of example and that various other embodiments are possible without departing from the subject matter coming within the scope of the following claims, which subject matter is regarded as the invention.

I claim:

1. In a machine for filling solid food products into containers, said machine having a feed hopper, a feed tube, a dosing assembly and a container filling station, wherein the dosing assembly includes a moving plate with a plurality of pockets adapted to be successively filled from the feed tube as the plate moves intermittently so that the pockets successively move beneath the feed tube, the improvement in the dosing assembly comprising a piston positioned beneath the feed tube to move upwardly into a respective pocket in said plate when the respective pocket is positioned beneath the feed tube, and to move downwardly from and clear the respective pocket such that the plate is free to move without interference during the intermittent movement of the plate;

a plurality of needle-like elements;

a plurality of apertures in the side of said feed tube each for receiving a different one of said needle-like elements; and means for intermittently advancing the needle-like elements so that they extend through respective apertures in the feed tube to form a gate across the feed tube which blocks movement of material therepast, and thereafter retracting the elements.

2. A machine as in claim 1 wherein said needle-like elements are substantially parallel with one another in a common plane which is substantially normal to the longitudinal axis of the feed tube.

3. A machine as in claim 2 wherein said needle-like elements are spaced above the bottom end of the feed tube by a distance at least as great as the greatest dimension of the food product being handled.

4. A machine as in claim 3 wherein the spacing of the needle-like elements above the bottom end of the feed tube is between 20 and 40 millimeters.

5. A machine as in claim 3 wherein the distance of movement of said piston is about one and one-half times the spacing of the needle-like elements above the bottom end of the feed tube.

6. A machine as in claim 2 wherein the needle-like elements are generally cylindrical in shape and have a diameter of between 0.5 and 2.5 millimeters.

7. A machine as in claim 6 wherein the needle-like elements are sharpened on their forward ends.

8. A machine as in claim 1 further including means for synchronizing the movement of the moveable plate, the piston and the needle-like elements so that the needle-like elements are advanced whenever the plate is in motion, the needle-like elements remain in their advanced position when the plate stops its movement, and the needle-like elements retract and allow the food products to fall into a pocket in the plate situated beneath the feed tube so that there is a dosed amount between the piston which has moved up into the pocket and the plane of the needle-like elements.

9. A process for filling small dimensioned food products into containers, said process comprising (a) providing a substantially vertically oriented feed tube and means for feeding the food products to the upper end of the feed tube so that the food products may traverse through the feed tube under the force of gravity;

(b) providing a plurality of needle-like elements positioned substantially parallel with each other in a common plane, with the common plane being substantially normal to the longitudinal axis of said feed tube and spaced from the bottom end of said feed tube;

(c) providing a plurality of spaced apertures in the side of said feed tube, said apertures being located in the common plane of said needle-like elements with the respective apertures being aligned with mutually respective needle-like elements;

(d) providing means for advancing and retracting the needle-like elements so that when the needle-like elements are advanced, they extend through the respective apertures in the feed tube and across the feed tube to form a gate across the feed tube which blocks movement of food products past the gate, (e) providing a revolving plate with a plurality of cylindrical openings which extend through the thickness of the plate, said cylindrical openings being spaced adjacent to and around the periphery of the plate, (f) providing a flat plate over which the revolving plate is mounted such that the lower surface of the revolving plate is immediately above the upper surface of the flat plate and the revolving plate rotates about an axis substantially normal to the upper surface of the flat plate, said flat plate having two spaced openings therein which are adapted to sequentially align and register with respective cylindrical openings in the revolving plate as the revolving plate rotates, one of said openings in said flat plate being directly beneath the feed tube, (g) providing a piston which is positioned beneath the feed tube within said one opening in said flat plate, said piston being adapted to move upwardly into a respective cylindrical opening in said revolving plate when the respective cylindrical opening is positioned beneath the feed tube, (h) rotating the revolving plate so that one of the cylindrical openings therein is directly beneath the feed tube, (i) moving the piston upwardly into the cylindrical opening in the revolving plate such that a predetermined volumetric dosing space is formed between the needle-like elements which extend across the feed tube and the piston, (j) retracting the needle-like elements from across the feed tube so that material in the feed tube drops downwardly and fills the dosing space above the piston, (k) advancing the needle-like elements so that they extend across the feed tube, (l) retracting the piston until it clears the cylindrical openings in the revolving plate, with the upper surface of the piston being positioned substantially within the plane of the upper surface of the flat plate, (m) rotating the revolving plate until the next subsequent cylindrical opening therein is directly beneath the feed tube, and repeating steps (i) through (m), whereby the filled cylindrical openings in the revolving plate move intermittently from the feed tube to the other opening in the flat plate wherein the contents therein are dropped into respective containers which are sequentially positioned beneath said other opening in the flat plate, and then the emptied cylindrical openings in the revolving plate rotate progressively back to their filling position beneath the feed tube.

10. In a machine for filling food products into containers in which said machine comprises a feed hopper, a feed tube, a dosing assembly and a container filling station, and wherein the dosing assembly includes a revolving plate with a plurality of pockets which are adapted to be filled successively from the feed tube as the revolving plate rotates intermittently so that the pockets move successively beneath the feed tube, the improvement comprising a plurality of needle-like elements positioned substantially parallel with each other in a common plane, said common plane being substantially normal to the longitudinal axis of said feed tube and spaced from the bottom end of said feed tube;

a plurality of spaced apertures in the side of said feed tube, said apertures being located in the common plane of said needle-like elements with the respective apertures being aligned with mutually respective needle-like elements; and means for intermittently advancing and retracting the needle-like elements so that when the needle-like elements are advanced, they extend through their mutually respective apertures in the feed tube to form a gate across the feed tube which blocks movement of material past the gate in the feed tube.

* * * * *